United States Patent [19]

Cartlidge

[11] Patent Number: 4,695,316

[45] Date of Patent: Sep. 22, 1987

[54] MULTIPLE INDUCTION FURNACE SYSTEM USING SINGLE POWER SUPPLY

[75] Inventor: Jesse M. Cartlidge, Trenton, N.J.

[73] Assignee: Inductotherm Corporation, Rancocas, N.J.

[21] Appl. No.: 879,691

[22] Filed: Jun. 27, 1986

[51] Int. Cl.[4] ..... C22B 4/00

[52] U.S. Cl. ..... 75/10.14; 373/7

[58] Field of Search ..... 75/10.14, 10.12; 373/7

[56] References Cited

U.S. PATENT DOCUMENTS

| | | | |
|---|---|---|---|
| 1,751,856 | 3/1930 | Greene | 75/10.14 |
| 1,828,291 | 10/1931 | Northrup | 373/7 |
| 1,849,309 | 3/1932 | Northrup | 373/7 |
| 2,013,653 | 9/1935 | Hoke | 75/10.14 |

*Primary Examiner*—Peter D. Rosenberg

*Attorney, Agent, or Firm*—Seidel, Gonda, Goldhammer & Abbott

[57] ABSTRACT

A system for simultaneously melting metal and holding molten metal for casting operations and the like comprises a plurality of coreless induction furnaces. Each furance has an induction coil having a plurality of coil turns. The induction coils of the furances are arranged to inductively heat metal in the furnaces and are connected in electrical series. A single power supply furnishes AC power to the series-connected induction coils. Electrical taps are located on each induction coil at spaced intervals along the coil for enabling electrical connections to be made to the induction coils at said intervals. Each interval comprises a preselected number of coil turns. Switch means are associated with each induction coil and connected to selected ones of the electrical taps for selectably switching a preselected number of coil turns into and out of circuit with the power supply for selectively melting or holding molten metal in the induction furnace associated with a selected coil.

3 Claims, 2 Drawing Figures

MULTIPLE INDUCTION FURNACE SYSTEM USING SINGLE POWER SUPPLY

BACKGROUND OF THE INVENTION

This invention relates to coreless induction furnaces and, in particular, relates to a system for simultaneously melting metal and holding molten metal for casting operations and the like which uses a plurality of coreless induction furnaces connected in series with a single AC power supply.

Coreless induction furnaces are, of course, well-known. The coreless induction furnace is a "batch" type metal melting furnace, which simply means that it is regularly charged with finite quantities of cold melting stock consistent with its rated capacity. When the charge has been melted and superheated to the desired pouring temperature, the furnace has completed its melting duties and the molten metal is available for use. At this point, the power to the furnace is either turned off or reduced in order to maintain the temperature of the molten metal during pouring. When the desired amount of molten metal has been removed from the furnace, the next charge is put in and full power is applied to the furnace to begin the next melt cycle. Thus, a full melting cycle consists of the time to melt and superheat the charge plus the subsequent period of "lost" time for such things as removing slag, checking the temperature and chemical analysis of the melt (and adjusting it, if necessary), tapping the furnace, and putting in the next charge.

The production capability of such a furnace is more or less directly related to the ratio of melting time to the overall cycle time. If the "lost" time can be kept to a minimum, the effective utilization of the equipment will be high and the actual production rate obtained will approach the designed melting rate of the furnace. Utilization figures of 75% to 80% are considered good in the industry, and there are even instances where 90% to 95% utilization has been obtained.

There are, however, many melting operations where the amount of lost time per melt cycle is unavoidably high. The resulting utilization can be as low as 40% to 50%, with correspondingly low production rates. This may be due to a number of reasons, including the following:

(a) There may be a long metallurgical treatment period required before the metal can be used;

(b) The particular molding system being used may require a large number of small ladles of molten metal;

(c) There may be limitations in the molten metal handling system which lengthens the time to empty the furnace; and (d) The skill or working methods of the operating personnel.

Where these conditions occur, the use of a standard batch melt/batch pour coreless induction furnace becomes less convenient and less economical. Thus, it is an object of the invention to improve the operating characteristics of the coreless induction furnace in situations where the percentage of lost time is high and equipment utilization is low.

Several prior attempts have been made to reduce the percentage of lost time and increase furnace utilization. In one prior method, a holding furnace with its own power supply (usually of a lower power rating than the melting furnace) is provided, completely separate from the melting furnace. When the melt cycle is finished, molten metal is transferred quickly and usually in large quantities from the melting furnace to the holding furnace, and the melting furnace is re-charged and the next melting cycle begun. In this manner, the utilization of the melting furnace can be very high. Metallurgical treatment may be done in the holding furnace, and molten metal is stored at the desired chemical analysis and pouring temperature, available to supply the casting line at any convenient rate and quantity.

A second prior method, known as a "butterfly" system, uses two coreless induction furnaces connected to a single power supply through power transfer switches. When the melt cycle in one of the furnaces is complete, power is switched in its entirety to the other furnace and its melting cycle commences, while the first furnace is being tapped. However, with no power applied to the first furnace, the molten metal temperature will gradually decrease, so that it may be necessary to switch power back to the first furnace periodically to re-heat the molten metal and keep the pouring temperature differential within acceptable limits.

A third prior system utilizes two furnaces and two power supplies, with power transfer switches so that each of the furnaces can be connected to either power unit. One of the power supplies has a high power rating for melting, and the other a low power rating suitable for holding molten metal at the pour temperature. When the melt cycle in the first furnace is complete, the melting power supply is switched to the other furnace to commence its melt cycle, and the holding power supply is switched to the first furnace to maintain the temperature of the molten metal. The furnaces are alternated from melting to holding throughout the working day.

All of the prior methods utilize two separate furnaces with varying methods of proportioning power to the furnace being tapped while the other furnace is in the melting cycle. All of the prior methods improve furnace utilization with a higher production rate than is possible with a single furnace and single power unit, and also provide a higher degree in pouring flexibility to the user.

However, all of the prior methods have certain disadvantages. The first method requires a great deal of floor space, has a high initial cost, and requires metal to be transferred from a melting furnace to a holding furnace. The "buttlerfly" system causes wide variations in pouring temperatures. The third prior method involves high initial costs.

It is an object of the present invention to provide the same separation of function between melting furnace and holding furnace to increase furnace utilization and productivity, but without the disadvantages of prior techniques.

SUMMARY OF THE INVENTION

The present invention is a system for simultaneously melting metal and holding molten metal for casting operations and the like. The system comprises a plurality of coreless induction furances each having an induction coil having a plurality of coil turns, the induction coils of the furnaces being arranged to inductively heat metal in the furnaces. The induction coils are connected in electrical series, and a single power supply is provided for supplying AC power to the series-connected induction coils. Connector means are provided on each induction coil at spaced intervals therealong for enabling electrical connections to be made to the induction coils at said intervals, each interval comprising a preselected number of coil turns. Switch means are associated with each induction coil and connected to selected ones of the tap means for selectably switching a preselected number of coil turns into and out of circuit with the power supply for selectively melting or holding molten metal in the induction furnace associated with a selected coil.

One embodiment of the invention is a dual coreless induction furnace system comprising first and second coreless induction furnaces each having an induction coil having a plurality of coil turns, the induction coils of the furnaces being arranged to inductively heat metal in the furnaces and being connected in electrical series with a single power supply. Connector means are located on each induction coil at spaced intervals therealong for enabling electrical connections to be made to the induction coils at said intervals, each interval comprising a preselected number of coil turns. Switch means are connected to selected ones of the connector means for selectably switching a preselected number of coil turns into and out of circuit with the power supply for selectively varying the heating effect of the induction coils on metal in the furnaces.

With the present invention, sufficient power to maintain a molten bath may be applied to one furnace, while at the same time sufficient power to melt a charge may be applied to the other furnace. Because the actual holding power required will vary with the temperature of the molten metal, metal level, furnace lining and slag cover conditions, etc., a means of altering the ratio of power to the two coils by switches is provided.

DESCRIPTION OF THE DRAWINGS

For the purpose of illustrating the invention, there is shown in the drawings a form which is presently preferred; it being understood, however, that this invention is not limited to the precise arrangement and instrumentalities shown.

DESCRIPTION OF THE INVENTION

Figure 1:
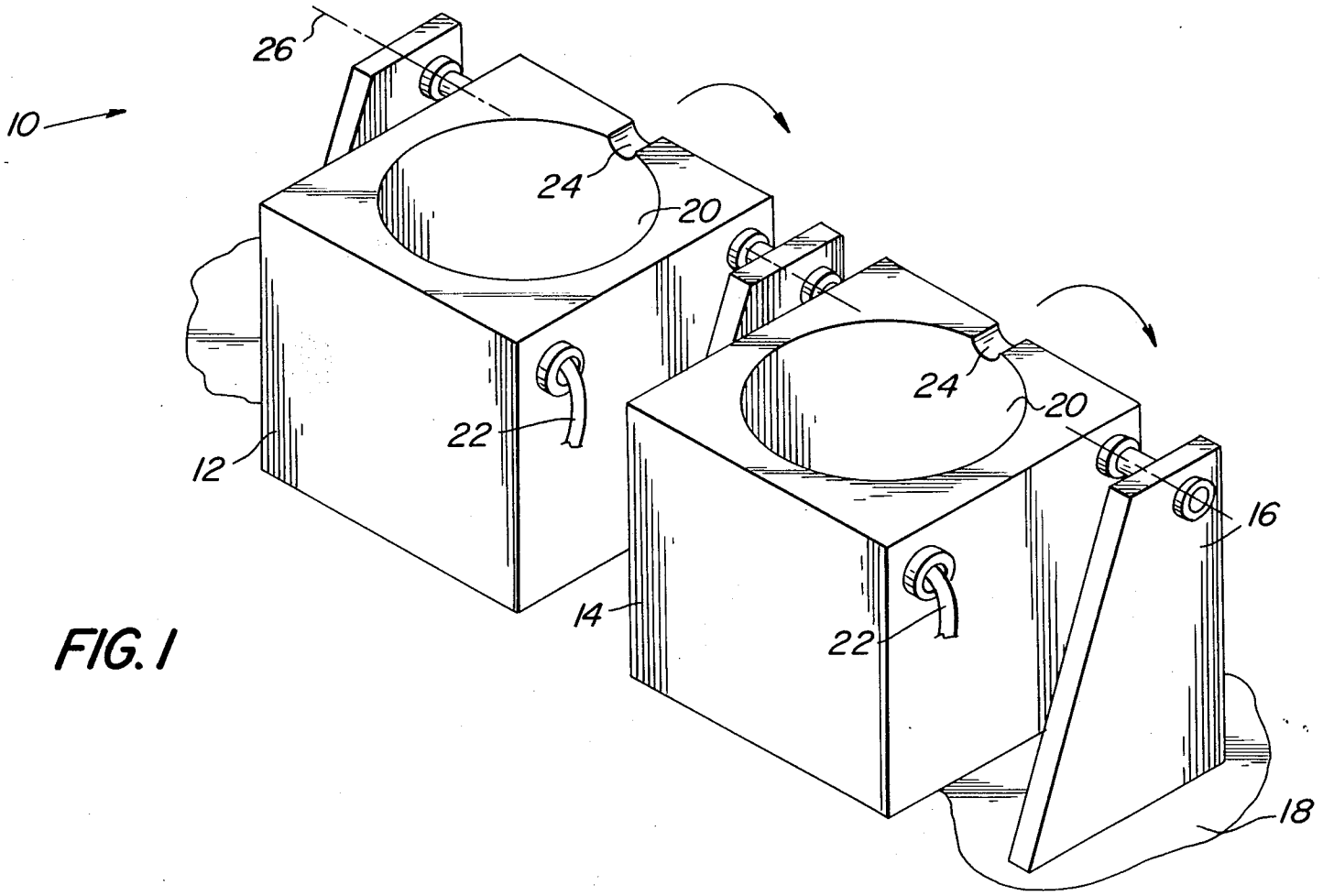
FIG. 1 is a simplified view of a dual coreless induction furnace system according to the present invention, showing the mechanical components of the system.

There is illustrated in FIG. 1 a dual coreless induction furnace system according to the present invention, showing the mechanical aspects of the invention. A pair of coreless induction furnaces 12 and 14 are mounted side-by-side on framework 16, which is in turn mounted on a base 18. Each furnace 12 and 14 is provided with a cavity 20 which receives and holds metal for melting. Cavity 20 may be provided with a crucible or lining, not shown, as required. An induction coil (not shown in FIG. 1), is provided in each furnace 12 and 14 around cavity 20 to inductively heat metal in the cavity. Electrical power is supplied to the induction coils by cables 22.

Each furnace 12 and 14 has a pouring lip 24 which facilitates the pouring of molten from the furnace. Each furnace 12 and 14 is pivotably mounted so that it can tilt about an axis 26 adjacent the pouring lip 24.

All of the foregoing mechanical structure of the invention will be well understood by those skilled in the art, and need not be described in any greater detail.

Figure 2:
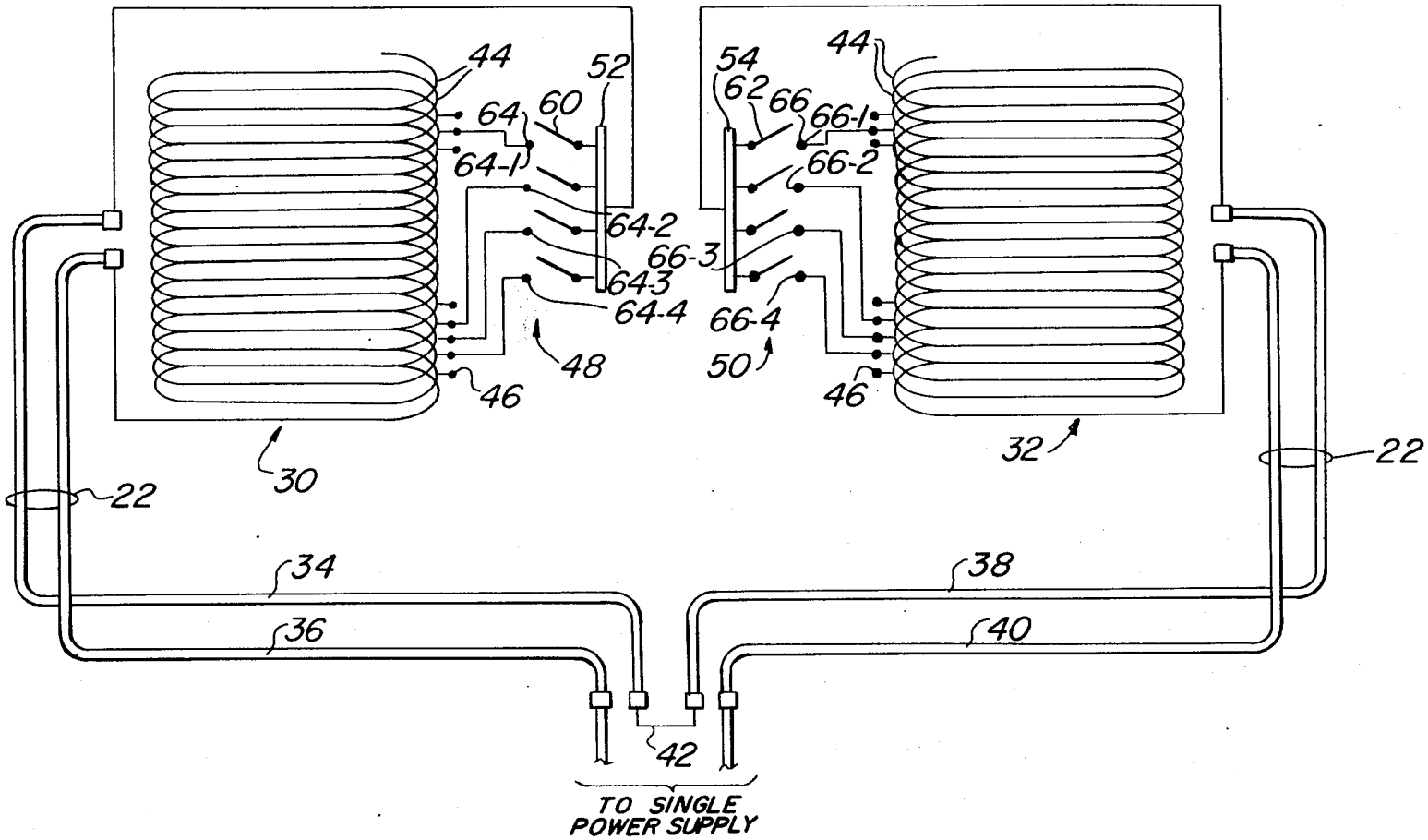
FIG. 2 is a simplified schematic diagram of the electrical features of the invention.

Referring now to FIG. 2, the electrical aspects of the present invention are shown in simplified schematic form. Two induction coils 30 and 32 are shown. Coil 30 may be considered to be the induction coil associated with furnace 12, while coil 32 may be considered to the induction coil associated with furnace 14. As already noted, electrical connection to coils 30 and 32 is made by means of cables 22. Each cable 22 consists of a pair of conductors, with conductors 34 and 36 being connected to coil 30 and conductors 38 and 40 being connected to coil 32. Conductors 36 and 40 are connected to the output terminals of a conventional AC induction furnace power supply (not shown) of sufficient power capacity to supply both coils 30 and 32. Conductor 36 is connected to one terminal of coil 30 while conductor 34 is connected to coil 30 through a selector switch. Likewise, conductor 40 is connected to one terminal of coil 32 while conductor 38 is connected to coil 32 through a similar selector switch. Conductors 34 and 38 are connected together by conductor 42. It can thus be seen that the series-connected coils 30 and 32 are connected electrically with with the power supply.

Each coil 30 and 32 is provided with a plurality of coil turns 44, in well-known manner. Located along coils 30 and 32 are a series of electrical taps 46, which are located along coils 30 and 32 at preselected locations spaced apart by a preselected number of coil turns. Taps 46 enable electrical connections to be made to coils 30 and 32 at intermediate points of the coils. Any number of taps 46 may be provided, and the taps may be spaced apart by any pre-selected number of coil turns.

Switches 48 and 50 are associated with coils 30 and 32, respectively. Each switch comprises a common terminal 52 and 54, respectively, which are connected together by conductors 34, 36, and 42 which become the series connection of coils 30 and 32. Each switch 48 and 50 comprises a plurality of contact arms 60 and 62, respectively. Contact arms 60 and 62 serve to make or break electrical connection between common terminals 52 and 54 and switch contacts 64 and 66, respectively. Switch contacts 64 and 66 are connected in turn to taps 46 on coils 30 and 32, respectively.

Switches 48 and 50 may be manually-actuated switches, or may be pneumatically- or motor-actuated switches. For purposes of illustrating the present invention, each switch is provided with four positions, designated 64-1 through 64-4 and 66-1 through 66-4, respectively, although any number of switch positions may be used without departing from the invention. Each switch is operable independently of the other switch. It will be appreciated that the selection of switch position determines the number of coil turns to be connected in the circuit. As those skilled in the art will readily understand, varying the number of coil turns connected to the power supply will vary the number of ampere-turns of that coil. This in turn will vary the heating effect of the coil on the metal in the furnace associated with that coil. By increasing the number of coil turns in circuit with the power supply, more heat can be supplied to the metal in the furnace. Conversely, by decreasing the number of coil turns in circuit with the power supply, less heat is supplied to the metal in the associated furnace. Thus, by controlling the number of coil turns in the circuit, the associated furnace can be used to selectably either melt metal or hold molten metal at a preselected temperature.

After determining the actual holding power of the particular furnace combination, switch positions 64-3 and 66-3 are connected to the number of coil turns that will produce approximately that power level when the power supply is delivering its full power to the combination of the two furnaces. Switch positions 64-2 and 66-2 are each connected to a somewhat greater number of turns, and switch positions 64-4 and 66-4 are connected to a somewhat fewer number of turns. Switch positions 64-1 and 66-1 are connected to the turns which present to the power supply a total impedance of two series-connected coils which approximates that of a single coil having the appropriate number of turns for the power supply used. The way in which the actual holding power of a particular furnace combination may be determined and the way in which the connection point for switch positions 64-1 and 66-1 may be determined, will be known to those of skill in the art.

A typical cycle of the system of the present invention is as follows:

Assuming that furnace 12 has just reached its desired pouring temperature, switches 48 and 50 are actuated to close contacts 64-3 and 66-1. This connects a greater number of turns in coil 32 in series with a lesser number of turns in coil 30, and therefore the largest portion of the total heating effect is delivered to furnace 14 to begin its melting cycle. At this point, the molten metal in furnace 12 may be treated metallurgically, if required; the slag removed; and the metal then poured at any rate or in any quantity desired to suit production requirements. The temperature of the molten bath in furnace 12 can also be checked periodically to make certain that it stays within the limits set by the user. If the temperature in furnace 12, which now acts as the holding furnace, becomes too high, switch 48 is actuated to connect position 64-4 with position 66-1 on coil 32. This reduces the number of connected coil turns in furnace 12 and therefore reduces the heating effect in furnace 12, which allows the temperature of the molten metal to decrease. Conversely, if the temperature becomes too low, switch 48 is actuated to connect position 64-2 in series with position 66-1 on coil 32. This increases the number of connected coil turns in furnace 12, which raises the temperature of the molten metal in furnace 12.

In general, a full furnace requires a higher holding power than one which is only partially filled. Therefore, the number of connected coil turns is usually reduced as the pouring progresses and the molten metal level drops in the furnace being tapped.

In the event that pouring of furnace 12 is finished before furnace 14 has completed its melting cycle, the next charge may be put into furnace 12 and it will begin to heat slowly, consistent with the low power being delivered to coil 30.

If there are delays to the casting operation which require that the melting/pouring operation be suspended for any length of time, switches 48 and 50 may be actuated to connected position 64-1 in series with position 66-1, and the power unit may be adjusted to approximately two times the furnace holding power on that tap setting. This maintains approximately the charge temperature in both furnaces, and the normal operating cycle may be resumed at any time simply by returning to the previous coil tap settings on switches 48 and 50.

It will be appreciated that the present invention permits the use of a single, standard induction power supply unit, with no special modifications needed to accommodate simultaneous melting and holding. Moreover, the ability of the invention to independently control the heating effect of each coil means that, regardless of how much the heat loss and holding power conditions of the holding furnace might vary over a period of time, the remainder of the power of the power supply is always delivered to the melting furnace. Except for the few seconds of power-off time required to operate the coil turn selector switches 48 and 50, the power supply can operate at 100% rated power output all of the time, which results in an extremely high equipment utilization figure and a high level of productivity. The system of the invention can also be easily retrofitted to suitable existing induction melting furnace systems with no additional floor space, cooling water, or electrical power required.

The present invention may be embodied in other specific forms without departing from the spirit or essential attributes thereof and, accordingly, reference should be made to the appended claims, rather than to the foregoing specification, as indicating the scope of the invention.

I claim:

1. A system for simultaneously melting metal and holding molten metal for casting operations and the like, comprising:

(a) a plurality of coreless induction furnaces each having an induction coil having a plurality of coil turns, the induction coils of the furnaces being arranged to inductively heat metal in the furnaces and being connected in electrical series, (b) a single power supply for supplying AC power to the series-connected induction coils, (c) connector means on each induction coil at spaced intervals therealong for enabling electrical connections to be made to the induction coils at said intervals, each interval comprising a preselected number of coil turns, and (d) switch means associated with each induction coil and connected to selected ones of the tap means for selectably switching a preselected number of coil turns into and out of circuit with the power supply for selectively melting or holding molten metal in the induction furnace associated with a selected coil.

2. A dual coreless induction furnace system comprising:

first and second coreless induction furnaces each having an induction coil having a plurality of coil turns, the induction coils of the furnaces being arranged to inductively heat metal in the furnaces and being connected in electrical series with a single power supply, connector means on each induction coil at spaced intervals therealong for enabling electrical connections to be made to the induction coils at said intervals, each interval comprising a preselected number of coil turns, and switch means connected to selected ones of the tap means for selectably switching a preselected number of coil turns into and out of circuit with the power supply for selectably varying the heating effect of the induction coils on metal in the furnaces.

3. A method of simultaneously melting metal and holding molten metal for casting operations and the like, comprising the steps of (a) providing a plurality of coreless induction furnaces each having an induction coil having a plurality of coil turns arranged to inductively heat metal in the furnaces, (b) connecting the induction coils in electrical series, (c) supplying AC power to the series-connected induction coils from a single power supply, (d) making electrical switching connections to the induction coils at spaced intervals therealong, each interval comprising a preselected number of coil turns, and (e) selectably switching a preselected number of coil turns into and out of circuit with the power supply for selectably melting or holding molten metal in the induction furnace associated with a selected coil.

* * * * *